US005362174A

United States Patent [19]

Yang

[11] Patent Number: 5,362,174

[45] Date of Patent: Nov. 8, 1994

[54] MANHOLE COVER

[76] Inventor: Jeng-Yih Yang, No. 129, Gong-Jenq Rd., Taichung City, Taiwan, Prov. of China

[21] Appl. No.: 33,796

[22] Filed: Mar. 18, 1993

[30] Foreign Application Priority Data

Mar. 19, 1992 [CN] China ..... 92205319.7

[51] Int. Cl.[5] ..... E02D 29/14

[52] U.S. Cl. ..... 404/25; 49/33; 52/20; 52/21

[58] Field of Search ..... 404/25; 52/20; 49/131

[56] References Cited

U.S. PATENT DOCUMENTS 625,605 6/1900 Faller ..... 49/33

4,203,686 5/1980 Bowman ..... 404/25

*Primary Examiner*—Ramon S. Britts

*Assistant Examiner*—Pamela Anne O'Connor

*Attorney, Agent, or Firm*—Browdy and Neimark

[57] ABSTRACT

A manhole cover comprises a base and a cover. The base has a first inner rim provided with a first bevel while the cover has a second outer rim provided with a second bevel. When the base is joined with the cover, the first bevel of the base and the second bevel of the cover are caused to make contact with each other such that the base is joined with the cover in an airtight and watertight manner. The first bevel of the base and the second bevel of the cover are of such construction that they enable the cover to be lifted easily to set apart from the base.

1 Claim, 2 Drawing Sheets

MANHOLE COVER

FIELD OF THE INVENTION

The present invention relates to a manhole cover, and more particularly to an airtight and watertight manhole cover.

BACKGROUND OF THE INVENTION

A manhole is an opening, often with a cover, through which a person can enter a sewer, conduit, tank, underground tunnel, etc. for a repair work or an inspection.

As shown in FIGS. 1 and 2, a conventional manhole cover comprises an annular base 1 and a cover 2 so dimensioned to fit into the annular base 1, which is provided with an annular groove 3 serving to receive therein a flange 4 of the cover 2. With a view to facilitating the removal of the cover 2 from the base 1, the furrow width of the annular groove 3 is greater than the thickness of the flange 4. In other words, the manhole cover 2 is not received in the annular base 1 in a watertight manner. As a result, the annular groove 3 can be easily inundated with the water, which can not be easily drained and which causes the corrosion of the manhole and even the. flooding of the facilities located under the manhole.

SUMMARY OF THE INVENTION

It is therefore the primary objective of the present invention to provide a manhole cover, which is airtight and watertight.

In keeping with the principles of the present invention, the foregoing objective of the present invention is attained by a manhole cover, which comprises a base and a cover. The base is provided at the upper circumference thereof with a first bevel. The cover is provided with an annular groove opposite in location to the first bevel of the base. The annular groove of the cover is provided therein with a second bevel opposite in location to the first bevel of the base. The first bevel of the base and the second bevel of the cover are so designed that they facilitate the removal of the manhole cover, and that they can be made to join together in an airtight and watertight manner at such time when the cover is placed on the manhole.

The foregoing objective, features and functions of the present invention can be more readily understood upon a thoughtful deliberation of the following detailed description of the present invention in conjunction with the accompanying drawings.

DETAILED DESCRIPTION OF THE INVENTION

Figure 1:
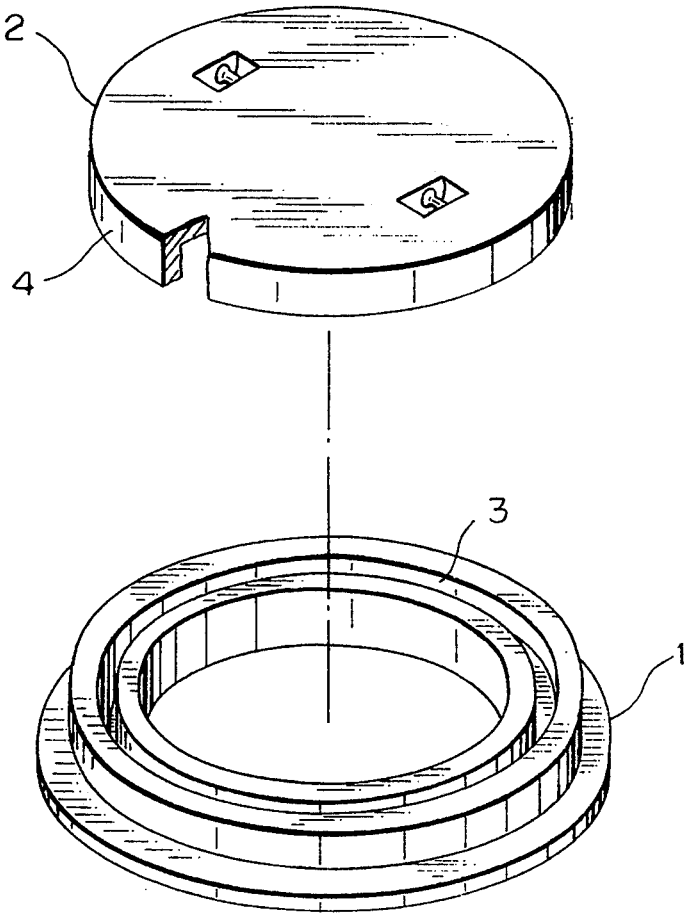
FIG. 1 PRIOR ART
FIG. 1 shows an exploded view of a manhole cover of the prior art.
Figure 2:
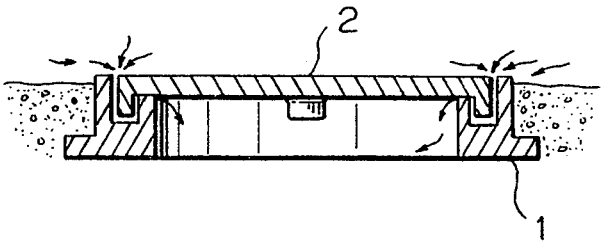
FIG. 2 PRIOR ART
FIG. 2 shows a sectional schematic view of the prior art manhole cover as shown in FIG. 1.
Figure 3:
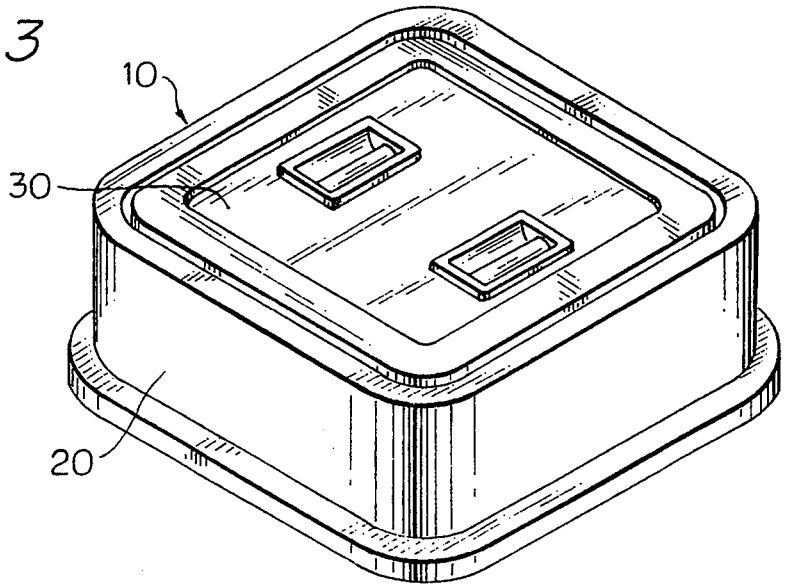
FIG. 3 shows a perspective view of a manhole cover of the present invention.
Figure 5:
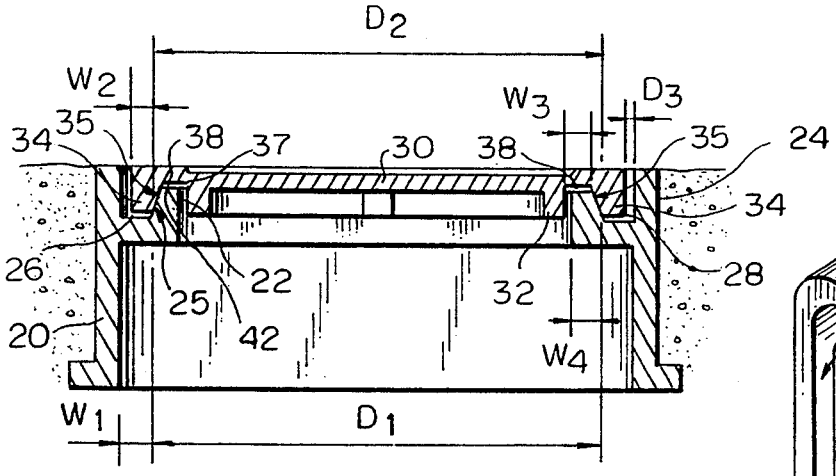
FIG. 5 shows a sectional schematic view of the manhole cover of the present invention.
Figure 4:
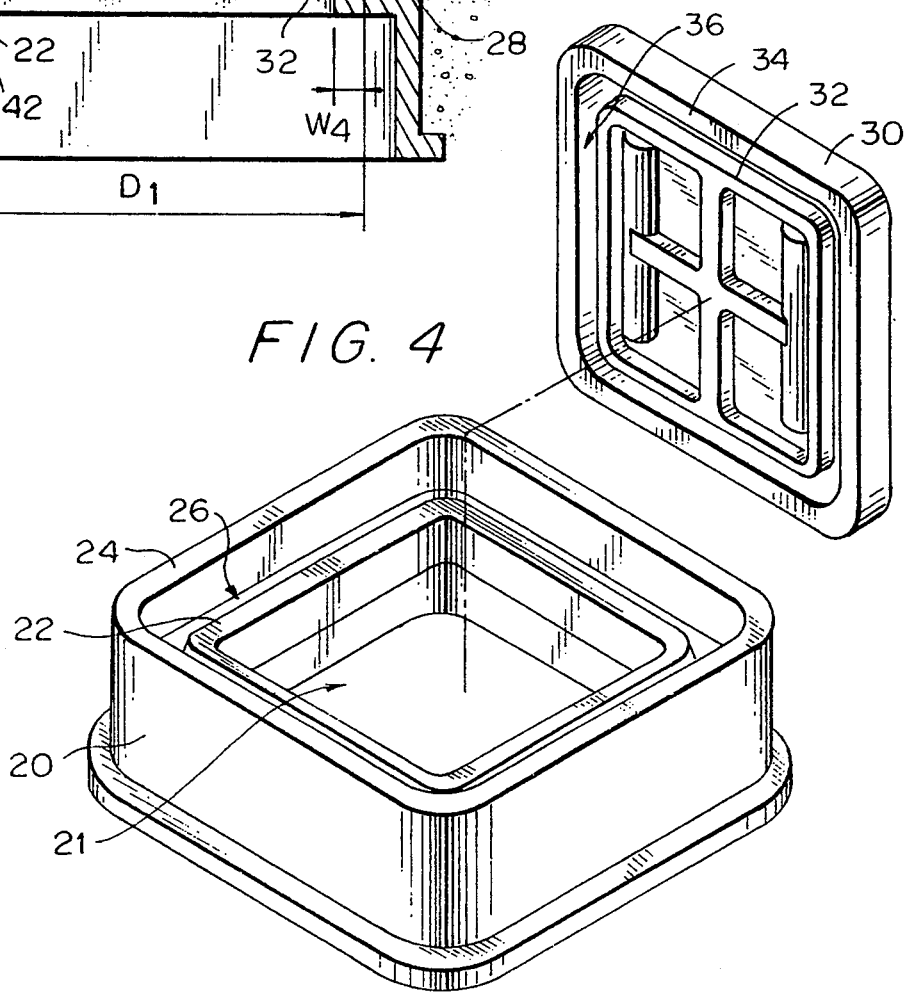
FIG. 4 shows an exploded view of the manhole cover of the present invention.

Referring to FIGS. 3–5, a manhole cover 10 embodied in the present invention is shown to comprise a base 20 and a cover 30.

The base 20 has an axial hole 21, a first inner rim 22, and a first outer rim 24. Located between the first inner rim 22 and the first outer rim 24 is a first groove 26. A first bevel 25 is disposed on an inner wall where the first inner rim 22 and the first groove 26 meet. The first bevel 25 has a downward inclination from the top thereof.

The cover 30 is provided on the underside thereof with a second inner rim 32, a second outer rim 34, and a second groove 36 located between the second inner rim 32 and the second outer rim 34. A second bevel 35 is formed on an inner wall where the second outer rim 34 and the second groove 36 meet. The second bevel 35 has a downward inclination from the top thereof. The first bevel 25 is corresponding in the bevel angle to the second bevel 35.

The first groove 26 has a bottom width W1, which is greater than a bottom thickness W2 of the second outer rim 34. The second groove 36 has a top width W3 that is greater than a top thickness W4 of the first inner rim 22. The smallest inner diameter D1 of the first bevel 25 is greater than the largest inner diameter D2 of the second bevel 35. As a result, when the cover 30 is placed properly on the base 20, the first inner rim 22 is received in place in the second groove 36 while the second outer rim 34 is inserted into the first groove 26. In the meantime, the first bevel 25 and the second bevel 35 are caused to make contact with each other such that the cover 30 is joined with the base 20 in an airtight and secure manner. It must be noted here that there is a gap 38 formed between the upper surface of the first inner rim 22 and a bottom surface 37 of the second groove 36 at such time when the base 20 is covered with the cover 30, and that there is a gap 28 formed between the lower surface of the second outer rim 34 and a bottom surface 42 of the first groove 26 at such time when the base 20 is covered with the cover 30. In other words, only the first bevel 25 and the second bevel 35 make contact with each other when the base 20 is joined with the cover 30.

As shown in FIG. 5, when the base 20 is Joined with the cover 30, the distance D3 between the second outer rim 34 of the cover 30 and the first outer rim 24 of the base 20 is about 3mm or more so as to facilitate the placing of the cover 30 on the base 20 and the lifting of the cover 30 from the base 20.

The manhole cover 10 of the present invention is characterized in that it is provided with the first bevel 25 and the second bevel 35, which serve to enable the base 20 to join with the cover 30 in an airtight and watertight manner. In addition, the first bevel 25 of the base 20 and the second bevel 35 of the cover 30 are caused to make contact with each other in such a manner that the cover 30 can be easily lifted to set apart from the base 20. Therefore, the manhole cover of the present invention has overcome the shortcomings of the manhole cover of the prior art.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A manhole cover comprising:

a base having an axial hole, a first inner rim, a first outer rim, and a first groove located between said first inner rim and said first outer rim; and a cover having a second inner rim, a second outer rim, and a second groove located between said second inner rim and said second outer rim;

wherein said first inner rim has an outer wall provided thereon with a first bevel inclined downward from the top thereof at an angle to an axis of said manhole cover; wherein said second outer rim has an inner wall provided thereon with a second bevel inclined downward from said cover corresponding to said first bevel at said angle; wherein said first groove has a bottom with an inner diameter that is greater than an outer diameter of a bottom of said second groove; wherein said first groove has a groove width greater than a thickness of said second outer rim while said second groove has a groove width greater than a thickness of said first inner rim; and wherein when said base is joined with said cover, said first inner rim is fitted into said second groove while said second outer rim is fitted into said first groove such that said first bevel and said second bevel make contact with each other to form a water tight seal, and that said first inner rim of said base remains a distance apart respectively from a bottom surface of said second groove and from said second inner rim, and further that said second outer rim of said cover remains a distance apart respectively from a bottom surface of said first groove and from said first outer rim.

* * * * *